US007032471B2

(12) United States Patent
Weber et al.

(10) Patent No.: US 7,032,471 B2
(45) Date of Patent: Apr. 25, 2006

(54) CONTROL DEVICE FOR CONTROLLING MACHINES BY HAND OR FOOT

(75) Inventors: Jürgen Weber, Dresden (DE); Helmut Renner, Halle (DE); Manfred Kurde, Hehenbucko (DE)

(73) Assignee: O&K Orenstein und Koppel AG, Berlin (DE)

( * ) Notice: Subject to any disclaimer, the term of this patent is extended or adjusted under 35 U.S.C. 154(b) by 0 days.

(21) Appl. No.: 10/149,408

(22) PCT Filed: Dec. 13, 2000

(86) PCT No.: PCT/EP00/12644

§ 371 (c)(1),
(2), (4) Date: Jun. 14, 2002

(87) PCT Pub. No.: WO01/44668

PCT Pub. Date: Jun. 21, 2001

(65) Prior Publication Data

US 2002/0178854 A1 Dec. 5, 2002

(30) Foreign Application Priority Data

Dec. 16, 1999 (DE) ..... 299 21 943 U
Dec. 22, 1999 (DE) ..... 199 61 052

(51) Int. Cl.
*G05G 1/04* (2006.01)

(52) U.S. Cl. ..... 74/469; 74/491; 74/512

(58) Field of Classification Search ..... 74/491, 74/471 XY, 473.11, 473.35, 518, 503, 512; 303/3, 15; 60/413, 469; 91/5
See application file for complete search history.

(56) References Cited

U.S. PATENT DOCUMENTS

| | | | | | |
|---|---|---|---|---|---|
| 2,754,505 | A | * | 7/1956 | Kenyon | 340/965 |
| 3,978,738 | A | * | 9/1976 | Naulin | 74/471 XY |
| 4,012,014 | A | * | 3/1977 | Marshall | 244/234 |
| 4,530,376 | A | * | 7/1985 | Chatterjea | 137/636.1 |
| 5,156,065 | A | * | 10/1992 | Fujimoto et al. | 74/527 |
| 5,289,902 | A | * | 3/1994 | Fujita | 187/346 |
| 5,452,745 | A | * | 9/1995 | Kordonsky et al. | 137/807 |
| 5,558,127 | A | * | 9/1996 | Maruyama et al. | 137/636.1 |
| 5,576,704 | A | * | 11/1996 | Baker et al. | 341/20 |
| 6,029,537 | A | * | 2/2000 | Nagao | 74/473.33 |

FOREIGN PATENT DOCUMENTS

| | | | |
|---|---|---|---|
| DE | 3622260 | | 1/1987 |
| EP | 0331177 | | 9/1989 |
| EP | 0889147 | | 1/1999 |
| JP | 5-112215 | * | 5/1993 |

* cited by examiner

*Primary Examiner*—William C. Joyce
(74) *Attorney, Agent, or Firm*—John William Stader

(57) ABSTRACT

The invention relates to a control device for controlling machines, especially hydraulic machines, by hand or foot. The inventive device comprises an actuating element (1), especially a pedal or a control lever, which can be moved in several directions. The aim of the invention is to feel a resisting force when the actuating element (1) is displaced or adjusted, whereby said force is on the scale of hydraulic forces having a direct effect. The actuating element (1) engages with a transmitter device (3) which is not hydraulic or is hydraulically decoupled from the hydraulic system. A damping device (6) engages with the actuating element (1). Said damping device defies the movement in at least one direction of motion pertaining to the actuating element (1) by means of a fluid that is moved by the actuating element (1).

13 Claims, 2 Drawing Sheets

CONTROL DEVICE FOR CONTROLLING MACHINES BY HAND OR FOOT

Figure 1:
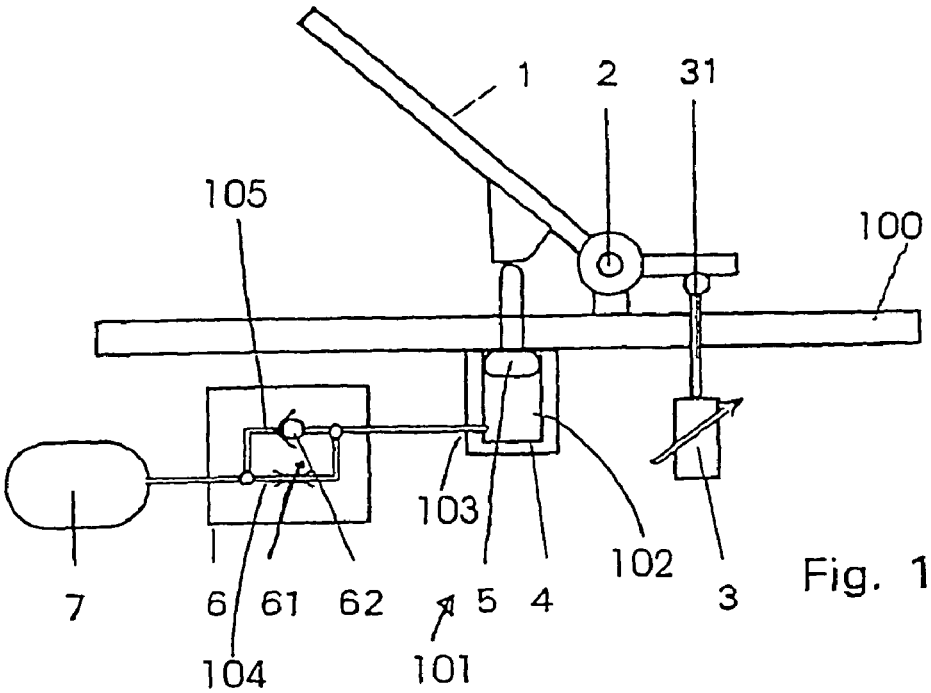

The invention relates to a control device for the manual or foot-operated control of machines with the features of the preamble of claim 1.

Machines with hydraulic drives, such as, e.g., diggers or front loaders, are often controlled by control levers and pedals, which operate via slide and valve systems directly on the hydraulic circuit. Through the reaction of the hydraulic fluid, these control elements or operating elements put up a certain resistance to the hand or foot when operated. Each lever can hereby be moved in at least two directions, e.g., forwards and backwards.

This power of resistance serves the operator of the machine as feedback for the actions he takes, thus rendering possible an easier execution of the movements of the machine.

Since hydraulic fluid is displaced in the system to cause a reaction after the movement of the control element, a damping of the movements of the control element further occurs, so that a feedback of uncontrollable machine vibrations and jerky movements of the machine on the control device can be largely prevented.

These advantages do not apply when the movements of the operating element are not directly transferred to the hydraulic system, but instead a control system, e.g., a control computer, is interposed between the operating element and the hydraulic system. In this case, the movement of the respective control element via intermediate parts, e.g., electrical slide resistance or rheostats, is converted into a signal, e.g., an electrical analog or digital signal. The resistance that the machine operator feels when operating an operating element, e.g., such a control lever, is often determined only by a return spring and essentially depends on the mechanical sensitivity of the sensor.

With diggers or similarly strongly moved machines, these forces are well below the retention forces which the operator of the machine needs to ensure a stable position in the cabin with the aid of his hands and feet.

Furthermore, jarring or jerky movements can very easily be entered into the control, making the safe guidance of the machine impossible.

A control device of the type mentioned at the outset is known from DE 36 22 260 A1. Here the operation of a control lever is damped by a damping device that features a piston that is moveable in a cylinder and separates two cylinder chambers from one another. The two cylinder chambers are connected by a bypass channel arrangement. A choke is arranged in a bypass channel of this arrangement. Prestressed back-pressure valves connected in counter-parallel are arranged in the two other bypass channels of this arrangement.

EP 0 899 147 A1 shows a driving pedal with damping device, in which a damping is caused by a piston which can be displaced in a cylinder. A choke and a back-pressure valve are arranged in the piston. The choke puts up an increased resistance to a movement of the piston in one direction, whereas the back-pressure valve permits a movement in the other direction with a reduced resistance. A spring is arranged parallel to the piston.

EP 0 331 177 A1 shows a control device with an active system for the targeted impingement of an operating element. The operating element features a damping piston for each direction of operation, which damping piston rests on the operating element with an extension prolongation. The other side of the piston is impinged with pressure by the hydraulic system, whereby the pressure can be adjusted through a pressure adjustment valve, specifically depending on the operating pressures in the system and a load acting on the system.

The object of the invention is to provide a control device for the manual or foot-operated control of machines, in which a power of resistance can be felt during shifting or adjusting the operating element, which power of resistance is in the order of magnitude of conventional machines.

This object is attained with a control device of the type mentioned at the outset by means of the features in the characterizing portion of claim 1.

It is now possible with the transmission device to generate signals which are emitted by the operating element in more or less any way. One is no longer dependent on adjusting a valve or a slide with the aid of the operating element which acts directly on the hydraulic system of the machine. However, in this case, as explained above, the necessary reaction force is lacking. The damping device is provided for this reason. With the aid of a fluid, which is moved when the operating element is operated, the damping device generates a resistance which is directed against the movement. This resistance is different from that generated by a simple return spring. For one thing, the resistance, which is generated with the aid of the moved fluid, can be substantially larger than the resistance of a simple return spring. For another, the resistance can be much better controlled over the length of movement of the operating element. If a correspondingly strong return spring is used, the resistance against the movement would have to increase a great deal. This is not inevitably the case with generating resistance with the aid of a moved fluid. The reduction of the fluid-filled cavity is a relatively simple possibility for building up a high resistance with the aid of a moved fluid. The flow-off speed of the fluid is a gauge of how quickly the cavity can be reduced. However, the reduction speed of the cavity is a gauge of how quickly the operating element can be moved. If the cavity is formed in a cylinder and is partially limited by a piston that is displaceable in the cylinder, whereby under the pressure of the fluid the piston rests against the operating element or a driving device connected to it, the piston is kept against the operating element during the entire operation of the operating element and thus puts up the corresponding resistance to the operating element upon movement in the corresponding direction. The piston interacts with a limit stop which is adjusted to the resting position of the operating element. This is particularly advantageous if the operating element can be moved in two opposite directions. The power of resistance during movement in one direction is then not masked by a corresponding elastic force in the other direction. Each damping device thus always acts only in one direction, putting up a corresponding resistance to the movement in this direction, whereas the movement of the operating element in the other direction remains uninfluenced by this damping device. In order for the fluid to be able to flow through the choke, a certain pressure difference has to be available via the choke, which pressure difference is generated by the operator building up the appropriate pressure in the cavity via the operating element. The flow-off behavior of the fluid from the cavity can be selectively controlled by the choice of the size of the choke. The flow-off stop valve thus opens for the fluid that wants to flow back from the outlet into the cavity. The fluid is thus practically unhindered from flowing back into the cavity, whereas the fluid can flow out of the cavity only through the choke. This embodiment has the advantage on the one hand that hardly any force is needed to reset the operating element. On the other hand, it has the advantage that a pressure can be used at the outlet in order to convey the fluid back into the cavity.

The damping device preferably puts up a basic resistance to a movement of the operating element from its resting position. This embodiment has several advantages. For one thing, the operator receives a corresponding resistance from the start of the movement, which resistance does not have to build up in the course of the movement. For another, it is ensured that the operating element can only be moved from a resting position when the operator actually intends to move it. Accidental movements, which can be caused by a vibration of the machine or by other outside influences, can be avoided with a relatively high reliability.

The damping device preferably puts up a reduced resistance to a movement of the operating element from a deflected position into its resting position. This resistance can be practically nothing at all. With this embodiment it is ensured that the operating element can return to its resting position quickly and without larger outside forces, whereas it requires greater forces to deflect the operating element from its resting position. This is linked, i.a., with a safety aspect. When the operator is no longer influencing it, the operating element is then automatically returned to its resting position, so that movements of the machine caused by shifting the operating element also cease.

The fluid is preferably under pressure. The defined basic resistance to the movement of the operating element is thus already generated at the start of the movement of the operating element.

The outlet of the cavity is preferably connected to an accumulator. The pressure of the fluid is accordingly defined in the accumulator so that the necessary basic resistance can already be generated at the start of the movement of the operating element. The level of the pressure in the accumulator is a gauge of this basic resistance.

It is particularly preferred here for the accumulator to contain a gas bubble. A certain spring characteristic can be achieved with the aid of this gas bubble, i.e., the pressure increases with increasing deflection or shifting of the operating element. The fluid is namely displaced in the accumulator such that it compresses the gas bubble. The gas bubble thereby generates a counterpressure dependent on the degree of compression, which counterpressure increases with the increasing degree of compression.

The fluid is preferably a hydraulic fluid. Hydraulic fluid is available in sufficient quantity with most hydraulic machines. The supply does not require additional expense.

It is provided in an alternative embodiment that the fluid features a viscosity which can be altered by the action of a control component. This viscosity is one of the values with which the flow-off behavior of a fluid can be changed. If the viscosity is altered, the flow-off speed is altered as well.

The fluid is preferably a magnetic fluid. A magnetic fluid changes its viscosity or its flow behavior when it is exposed to a magnetic field. A magnetic field can be generated by a magnet, e.g., an electromagnet, in order to change the flow-off speed.

It is provided in an alternative embodiment that the fluid is a compressed gas. The appropriate damping can also be caused by a gas.

The choke is preferably adjustable. The flow-off speed—and thus the resistance behavior—can then be changed with little effort. For instance, the resistance behavior can be adapted to the requirements of a special vehicle or a special operator.

The operating element is preferably a pedal which can be pivoted about an axis or a rocker lever. These are the most common control devices which can be controlled well with the damping device.

It is also preferred for the operating element to be a universal-mounted control lever which features a driver ring surrounding it at right angles to its longitudinal extension near the universal mounting, which driver ring rests on the piston in the resting position. A damping thus occurs in virtually every movement direction.

It is particularly preferred here that a different resistance is assigned to a first pair of movement directions than to a second pair of movement directions which is perpendicular to the first pair of movement directions. It is thus possible, e.g., to put up a stronger resistance to lateral movements than to lengthwise movements, in order to give the machine operator a feeling for the exact guidance in a forwards-backwards direction.

The invention is described in further detail below on the basis of preferred exemplary embodiments in connection with the drawing.

These show:

FIG. 1 A control device with a simple-action pedal

Figure 2:
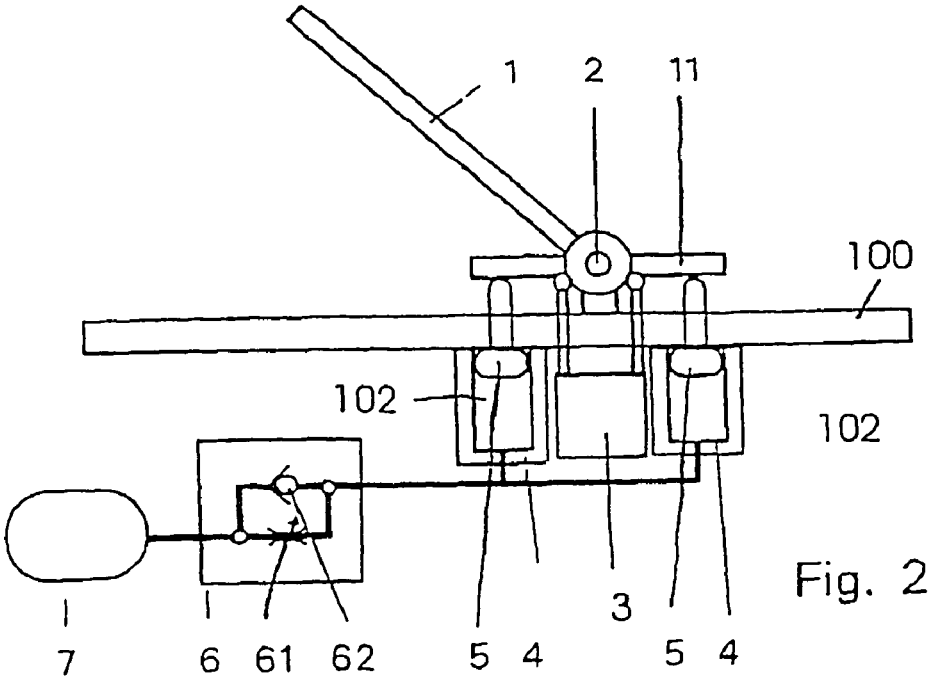

FIG. 2 A control device with a pedal embodied as a rocker lever

Figure 3:
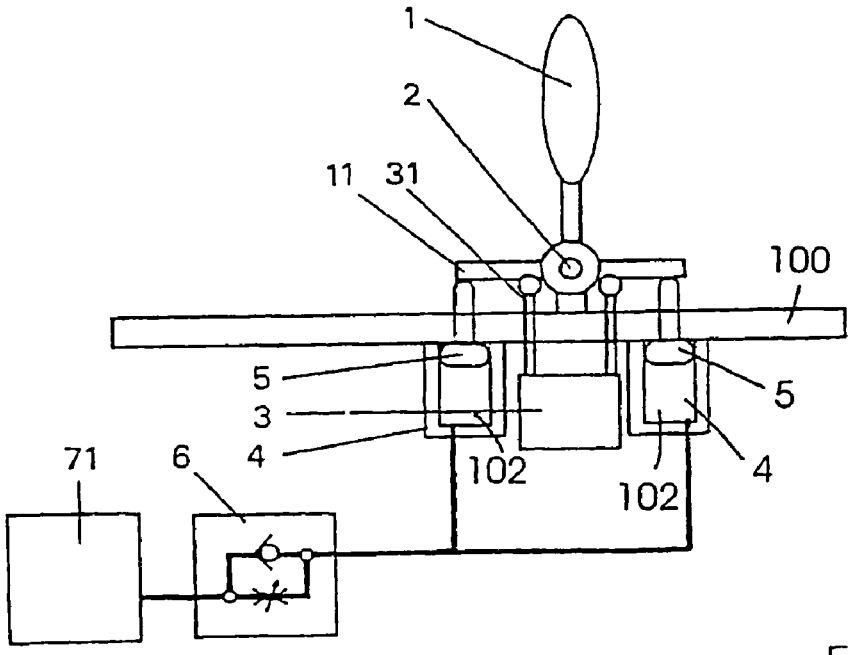
Figure 4:
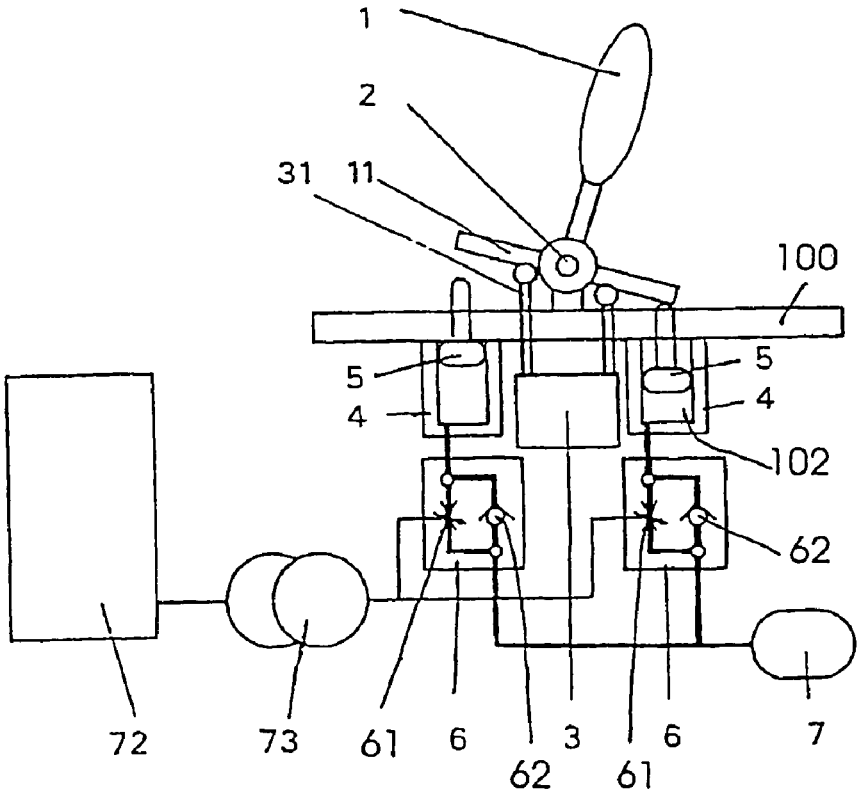

FIG. 3 A control device with an operating element in the form of a control lever with a choke-valve combination; and FIG. 4 A control device with an operating element in the form of a control lever with several choke-valve combinations and a choke control dependent on a work circuit.

FIG. 1 shows an embodiment of a control device with a simple pedal. This embodiment is intended to show the fundamental idea of the invention.

An operating element 1 in the form of a pedal supported on a baseplate 100 in a bearing 2 is connected to a transmission device 3 via a coupling device 31. The transmission device 3 generates a signal in a way that is not shown, but known per se, with a movement of the operating element 1, which signal is converted into hydraulic pressures via a processing unit (not shown in detail), e.g., a control computer. To this end the control computer operates, e.g., predetermined valves in the hydraulic circuit of a machine, e.g., a digger or a loader. The signals emitted by the transmission device 3 are usually in electrical form, whereby they can be analog or digital. However, it is also possible for the transmission device 3 to generate pneumatic, optical or hydraulic signals, whereby in the latter case the signal path is uncoupled from the hydraulic work circuit.

In addition to the transmission device 3, a damping device 101 is arranged in the operating direction of the control element 1 embodied as a pedal. The damping device features a cylinder 4 in which a piston 5 is displaceably guided between two end positions. The piston 5 is thereby arranged such that in the starting position of the pedal it is located in its upper end position. This end position is defined by the impact of the piston on the base plate 100. It is not possible to move the piston 5 beyond this end position.

When operating the pedal, thus when operating the operating element 1, the piston 5 is pushed into the cylinder 4.

A cavity 102 is formed in the cylinder 4, which cavity is limited by the cylinder 4 and the piston 5. When the piston 5 is pushed into the cylinder 4, the cavity 102 is reduced. The cavity 102 is filled with a hydraulic fluid. When the cavity 102 is reduced, the hydraulic fluid is displaced outwards via an outlet 103 and reaches an accumulator 7 via a damping element 6. The damping element 6 contains in an outflow path 104 a choke 61 which forms a device for controlling the flow-off speed of the hydraulic fluid. The choke resistance of the choke 61 can be adjusted if necessary, as indicated by an arrow.

An inflow path 105 is arranged parallel to the outflow path 104. A valve 62 is provided in the inflow path 105, which valve is embodied as a back-pressure valve. The valve 62 opens into the cavity 102 and closes in the direction of the accumulator 7. A predetermined pressure prevails in the accumulator 7. This pressure prevails when the piston 5 is in its upper end position, also in the cavity 102. A certain basic resistance of the operating element 1 is thus set by the pressure available in the accumulator 7.

A gas bubble can be contained in the accumulator 7, the size of which gas bubble is adjusted to the volume of the cavity 102 in the cylinder 4. With appropriate sizing the counterpressure in the accumulator 7 can increase upon the deflection of the operating element 1. The machine operator thus receives a feedback on the degree of operation of the operating element 7.

The adjustment of the choke 61 causes a higher resistance to be opposed to a rapid depressing of the pedal than is the case with a slow depressing of the pedal. This rules out above all the transfer of jerky movements or vibrations of the machine to the transmission device 3 via the pedal.

The resistance against the movement of the operating element 1 is only built up by movements in one direction, i.e., the movement of the operating element 1 from its resting position. When the operating element 1 is moved in another direction, namely in the opposite direction, the choke device 6 produces basically no resistance. The hydraulic fluid is conveyed back into the cavity 102 by the pressure in the accumulator 7 via the valve 62 which then opens, so that the piston 5 can directly follow the movement of the operating element 1.

FIG. 2 shows another exemplary embodiment, in which the operating element 1 is embodied as a pedal operating in a two-sided manner, i.e., as a rocker lever. The same elements are given the same reference number. Cylinder 4 and piston 5, which enclose a cavity 102, are provided for both movement directions here. Each piston-cylinder-unit operates only when the operating element 1 is moved from the resting position shown in FIG. 2. No resistance is opposed to a movement of the operating element 1 from a deflected position back into the resting position. The precise adjustment of the normal position when releasing the pedal is ensured by the upper end stops of the piston 5 which is formed by the baseplate 100.

In the embodiments explained in FIGS. 1 and 2, the damping occurs by a hydraulic fluid being displaced by the chokes 61 when the cavities 102 are reduced. However, it is just as possible for a gas to be used instead of a hydraulic fluid. In this case, the choke 61 will have to be sized differently.

FIG. 3 shows an embodiment of the control device, in which the operating element is embodied as a control lever or joystick. Only one pair of movement directions is shown for reasons of clarity, i.e., from left to right and from right to left. The same parts are given the same reference numbers.

A piston 5 is provided in the cylinders 4 for each movement direction, whereby the outlets of both cavities 102 thus formed are connected to a joint damping element 6, which is structured identically to the exemplary embodiment of FIG. 1.

The operating element 1 can also be suspended on gimbals, whereby only one axis is shown, as mentioned above.

In order to have a counter force dependent if possible only on the regulating speed of the operating element 1, it is provided in this exemplary embodiment that the basic pressure in the cavities 102 of the cylinders 4 is derived from the control circuit 71 of the hydraulic pump.

FIG. 4 shows another exemplary embodiment which shows that only the piston 5 located in the movement direction is pushed into the cylinder 4, in order to reduce the cavity 102 arranged therein.

In this example each cylinder 4 is assigned a damping element 6 featuring a choke 61 and a valve 62. A varying counter force can thus be assigned to different movement directions on the movement of the operating element. For instance, a forward movement can be assigned a greater counter force than a backward movement. However, such an embodiment is designed in principle so that several pairs of movement directions are available, whereby the pairs of movement directions are aligned perpendicular to one another. In this case, a greater resistance force can be opposed to a lateral movement than to a forward-backward movement, so that it is possible to give the machine operator a feeling for the exact guidance in the forward-backward direction.

FIG. 4 also shows in a diagrammatic representation that the chokes 61 can be controlled with a control pressure that is derived via a pressure transducer 73 out of the work circuit 72 of the hydraulic machine. In this case, the damping, i.e., the resistance force opposed to the movement, automatically increases with the increase in the strain on the machine, which in most cases is also accompanied by increased vibrations of the system.

Of course, the pressure of the work circuit 72 transformed via a pressure transducer 73 can also be used to adjust the working pressure in the cavity 102 in the cylinders 4. The machine operator is thus given a feedback on particular pressures of the machine. For instance, the pressure in cylinder 4 can be increased so much when the digger bucket comes across an obstacle that when the load limit is reached only a retraction of the lever is possible, so that a deliberate overload of the machine can be prevented.

In the embodiments explained in FIGS. 1 through 4, the damping occurs by a hydraulic fluid being displaced by the chokes 61 when the cavities 102 are reduced. However, it is just as possible for a gas to be used instead of a hydraulic fluid. In this case, the choke 61 will have to be sized differently.

If a magnetic fluid is selected as the fluid, the viscosity of the fluid can be changed by arranging an electromagnet in the outflow path and impinging the electromagnet (not shown) with electricity. If the viscosity is changed, the outflow behavior is changed, i.e., a more viscous fluid is braked more by the choke 61 than a thinner fluid.

The invention claimed is:

1. Control device for hand or foot-operated control of a machine, comprising: an operating element that can be moved in one or more directions for controlling a non-hydraulic transmission device or a transmission device hydraulically uncoupled from a hydraulic system of a machine, for generating one or more electrical, pneumatic, hydraulic or optical control signals for operating an element of the hydraulic system of the machine; a damping device which interacts with the operating element by providing a resistance to the movement of the operating element in at least one movement direction, the back-pressure valve allows fluid flow therethrough in a first direction and prevents fluid flow therethrough in an opposite second direction, thereof, a cylinder having a cavity containing a piston positionable in a first end position in the cavity and movable therefrom toward a second end position in the cylinder by movement of the operating element or a driver connected thereto in the one movement direction to cause simultaneous displacement of a fluid located in the cavity of the cylinder under pressure, the cavity of the cylinder being connected by fluid lines with the damping device, and the damping device being operable to control at least one of an outflow speed of the fluid displaced from the cavity and an inflow speed of fluid to the cavity, whereby the damping device includes at least one adjustable choke and at least one back-pressure valve connected in parallel between the cavity and an accumulator, the accumulator containing fluid under a pressure which will increase as fluid is displaced from the cavity so as to increase the resistance to the movement of the operating element in the one movement direction.

2. Device according to claim 1, characterized in that the damping device puts up a basic resistance to a movement of the operating element from a resting position.

3. Device according to claim 1, characterized in that the damping device puts up a reduced resistance to a movement of the operating element from a deflected position into a resting position.

4. Device according to claim 1, characterized in that the choke is adjustable by a pressure transducer.

5. Device according to claim 1, characterized in that an outlet of the cavity is connected to an accumulator.

6. Device according to claim 5, characterized in that the accumulator contains a gas bubble.

7. Device according to claim 1, characterized in that the fluid is a hydraulic fluid.

8. Device according to claim 1, characterized in that the fluid is a magnetic fluid.

9. Device according to claim 1, characterized in that the fluid is a compressed gas.

10. Device according to claim 1, characterized in that the operating element is a pedal which can be pivoted about an axis or a rocker lever.

11. A control device for controlling a machine movement, comprising:

an operating element movable in at least one predetermined direction from a predetermined position by a hand or foot movement, for controlling a non-hydraulic transmission device or a transmission device hydraulically uncoupled from a hydraulic system of the machine, for generating at least one control signal causing a movement of the machine;

a cylinder including a cavity containing a piston movable therein from a first end position adjacent to a first end of the cavity toward a second end position adjacent to a second end of the cavity by movement of the operating element from the rest position through a range of deflected positions, the second end of the cavity containing a fluid which is displaced under pressure therefrom by the movement of the piston toward the second end position; and a damping device including a choke for restricting a flow of fluid therethrough, and a valve which allows fluid flow therethrough in a first direction and prevents fluid flow therethrough in an opposite second direction, and an accumulator, the choke and the valve being connected in parallel between the second end of the cavity of the cylinder and the accumulator, such that when the operating element is moved from the predetermined position in the one direction, the fluid displaced from the second end of the cavity will flow through the damping device to increase a pressure condition therein which will be transmitted through the fluid and the piston to the operating element to provide increased resistance to the movement of the operating element.

12. The control device of claim 11, wherein the choke is operable for variably resisting a flow of fluid therethrough under control of a pressure transducer in connection with a work circuit of the machine.

13. A control device for controlling a machine movement, comprising:

an operating element movable in at least one predetermined direction from a predetermined position by a hand or foot movement, for controlling a non-hydraulic transmission device or a transmission device hydraulically separate from a hydraulic system controlled by movement of the operating element, for generating at least one control signal for causing a movement of at least an element of the machine;

a cylinder including a cavity containing a piston movable therein by movement of the operating element, whereby movement of the operating element in the predetermined direction will cause a fluid contained in the cavity to be displaced therefrom under pressure; and a damping device including a choke for restricting flow of a fluid therethrough, a valve which allows fluid flow therethrough in a first flow direction and which prevents fluid flow therethrough in an opposite second flow direction, and an accumulator, the choke and the valve being connected in parallel between the cavity for receiving the fluid discharged under pressure therefrom and the accumulator, whereby if the operating element is moved in the predetermined direction from the predetermined position the fluid displaced under pressure from the cavity will flow through the damping device toward the accumulator to increase a pressure condition therein which will be transmitted through the fluid and the piston to exert a resistance force against the operating element which will increase as the operating element is moved in the predetermined direction from the predetermined position.

* * * * *